US010405376B2

(12) United States Patent
Jang

(10) Patent No.: US 10,405,376 B2
(45) Date of Patent: Sep. 3, 2019

(54) APPARATUS AND METHOD FOR TREATING SUBSTRATE

(71) Applicant: Semes Co., Ltd., Cheonan-si, Chungcheongnam-do (KR)

(72) Inventor: Soo Ill Jang, Asan-si (KR)

(73) Assignee: Semes Co., Ltd., Chungcheongnam-do (KR)

( * ) Notice: Subject to any disclaimer, the term of this patent is extended or adjusted under 35 U.S.C. 154(b) by 546 days.

(21) Appl. No.: 14/789,447

(22) Filed: Jul. 1, 2015

(65) Prior Publication Data

US 2016/0021702 A1 Jan. 21, 2016

(30) Foreign Application Priority Data

Jul. 16, 2014 (KR) ..... 10-2014-0089871

(51) Int. Cl.
*H05B 1/02* (2006.01)
*H05B 3/00* (2006.01)

(52) U.S. Cl.
CPC ..... *H05B 3/0047* (2013.01); *H05B 1/0233* (2013.01)

(58) Field of Classification Search
CPC ..... H05B 1/0233; H05B 3/0047
See application file for complete search history.

(56) References Cited

U.S. PATENT DOCUMENTS 5,593,608 A * 1/1997 Suzuki ..... H05B 1/0233 219/486
6,469,283 B1 10/2002 Burkhart et al.
6,822,185 B2 * 11/2004 Welch ..... H01J 37/32458 219/121.43
2002/0143426 A1 * 10/2002 Starner ..... G05D 23/1935 700/207
2004/0099651 A1 * 5/2004 Johnson ..... F27B 17/0025 219/390
2008/0219650 A1 * 9/2008 Suzuki ..... H01L 21/67109 392/408

(Continued)

FOREIGN PATENT DOCUMENTS

CN 1956143 A 5/2007
JP 2000-193375 A 7/2000

(Continued)

*Primary Examiner* — Alexander Markoff
(74) *Attorney, Agent, or Firm* — Harness, Dickey & Pierce, P.L.C.

(57) ABSTRACT

The inventive concepts relate to an apparatus for treating a substrate. The apparatus includes a container having a treatment space of which a top end is opened, a rotatable support unit supporting a substrate disposed within the treatment space, a heating unit heating the substrate supported by the support unit, and a fluid supply unit supplying a fluid to the substrate disposed on the support unit. The heating unit includes a plurality of heaters installed in a plurality of zones of the support unit, respectively, and a controller controlling the plurality of heaters. The controller controls the plurality of heaters by a first mode until the plurality of zones reach a target temperature, and the controller controls the plurality of heaters by a second mode different from the first mode after the plurality of zones reach the target temperature.

6 Claims, 9 Drawing Sheets

(56) References Cited

U.S. PATENT DOCUMENTS

| | | | | |
|---|---|---|---|---|
| 2011/0308453 | A1* | 12/2011 | Su | C23C 16/303 118/708 |
| 2012/0003599 | A1* | 1/2012 | Patalay | H01L 21/67115 432/227 |
| 2012/0031892 | A1* | 2/2012 | Shigetomi | H01L 21/67248 219/444.1 |
| 2013/0270250 | A1* | 10/2013 | Pease | H01L 21/67103 219/443.1 |
| 2013/0284721 | A1* | 10/2013 | Yang | H05B 3/12 219/553 |
| 2014/0017848 | A1* | 1/2014 | Ragay | H05B 3/0076 438/72 |
| 2014/0105582 | A1* | 4/2014 | Tallavarjula | H05B 3/0047 392/416 |
| 2015/0034133 | A1* | 2/2015 | Kim | H01L 21/67051 134/105 |
| 2016/0135252 | A1* | 5/2016 | Matyushkin | H01L 21/67109 219/521 |

FOREIGN PATENT DOCUMENTS

| | | | |
|---|---|---|---|
| JP | 2001-203195 | A | 7/2001 |
| JP | 2011-077276 | A | 4/2011 |
| KR | 100192238 | B1 | 6/1999 |
| KR | 100395662 | B1 | 8/2003 |
| KR | 100638406 | B1 | 10/2006 |
| KR | 2014-0084733 | A | 7/2014 |

* cited by examiner

APPARATUS AND METHOD FOR TREATING SUBSTRATE

CROSS-REFERENCE TO RELATED APPLICATION

This U.S. non-provisional patent application claims priority under 35 U.S.C. § 119 to Korean Patent Application No. 10-2014-0089871, filed on Jul. 16, 2014, in the Korean Intellectual Property Office, the disclosure of which is hereby incorporated by reference in its entirety.

BACKGROUND

The inventive concepts relate to an apparatus for treating a substrate and a method for treating a substrate using the same. More particularly, the inventive concepts relate to an apparatus for treating a substrate while heating the substrate and a method for treating a substrate using the same.

Various treating processes such as a photoresist-coating process, a development process, a cleaning process, and an ashing process may be generally performed on a glass substrate or a wafer when a flat display device or a semiconductor device is manufactured.

The cleaning process may include a chemical treating process, a rinse process, and a drying process which are performed on a substrate.

An apparatus for heating a substrate may be used to increase an etch rate of an etch target layer when the substrate is treated using a high-temperature chemical. However, the substrate heating apparatus may not uniformly heat an entire region of the substrate, so an etch rate may not be uniform on the substrate. In other words, an etch rate of a first region of the substrate may be different from that of a second region, different from the first region, of the substrate.

SUMMARY

Embodiments of the inventive concepts may provide a substrate treating apparatus capable of providing a uniform cleaning rate on an entire region of a substrate during a process of cleaning the substrate, and a method for treating a substrate using the same.

Embodiments of the inventive concepts may provide a substrate treating apparatus capable of uniformly applying heat to an entire region of a substrate during a cleaning process for providing a uniform cleaning rate on the entire region of the substrate, and a method for treating a substrate using the same.

In one aspect, an apparatus for treating a substrate may include a container having a treatment space of which a top end is opened, a rotatable support unit supporting a substrate disposed within the treatment space, a heating unit heating the substrate supported by the support unit, and a fluid supply unit supplying a fluid to the substrate disposed on the support unit. The heating unit may include a plurality of heaters installed in a plurality of zones of the support unit, respectively, and a controller controlling the plurality of heaters. The controller may control the plurality of heaters by a first mode until the plurality of zones reach a target temperature, and the controller may control the plurality of heaters by a second mode different from the first mode after the plurality of zones reach the target temperature.

In an embodiment, the plurality of zones may include a central zone having a circular shape concentric with the support unit, and an edge zone having a ring shape concentric with the central zone.

In an embodiment, each of the heaters may include a lamp, and the lamps disposed in the plurality of zones may be arranged at equal distances.

In an embodiment, the lamps may have ring shapes concentric with the support unit.

In an embodiment, the controller may provide the plurality of lamps with powers different from each other in the first mode.

In an embodiment, the power provided to the lamp disposed in the central zone may be greater than the power provided to the lamp disposed in the edge zone.

In an embodiment, the controller may heat each of the plurality of lamps by a proportional integral derivative (PID) control method in the second mode.

In another aspect, a method for treating a substrate may include uniformly heating a substrate supported by a support unit by means of a plurality of heaters respectively installed in a plurality of zones of the support unit. The plurality of heaters may be controlled by a first mode until the plurality of zones reach a target temperature, and the plurality of heaters may be controlled by a second mode different from the first mode after the plurality of zones reach the target temperature.

BRIEF DESCRIPTION OF THE DRAWINGS

The inventive concepts will become more apparent in view of the attached drawings and accompanying detailed description.

DETAILED DESCRIPTION OF THE EMBODIMENTS

Figure 1:
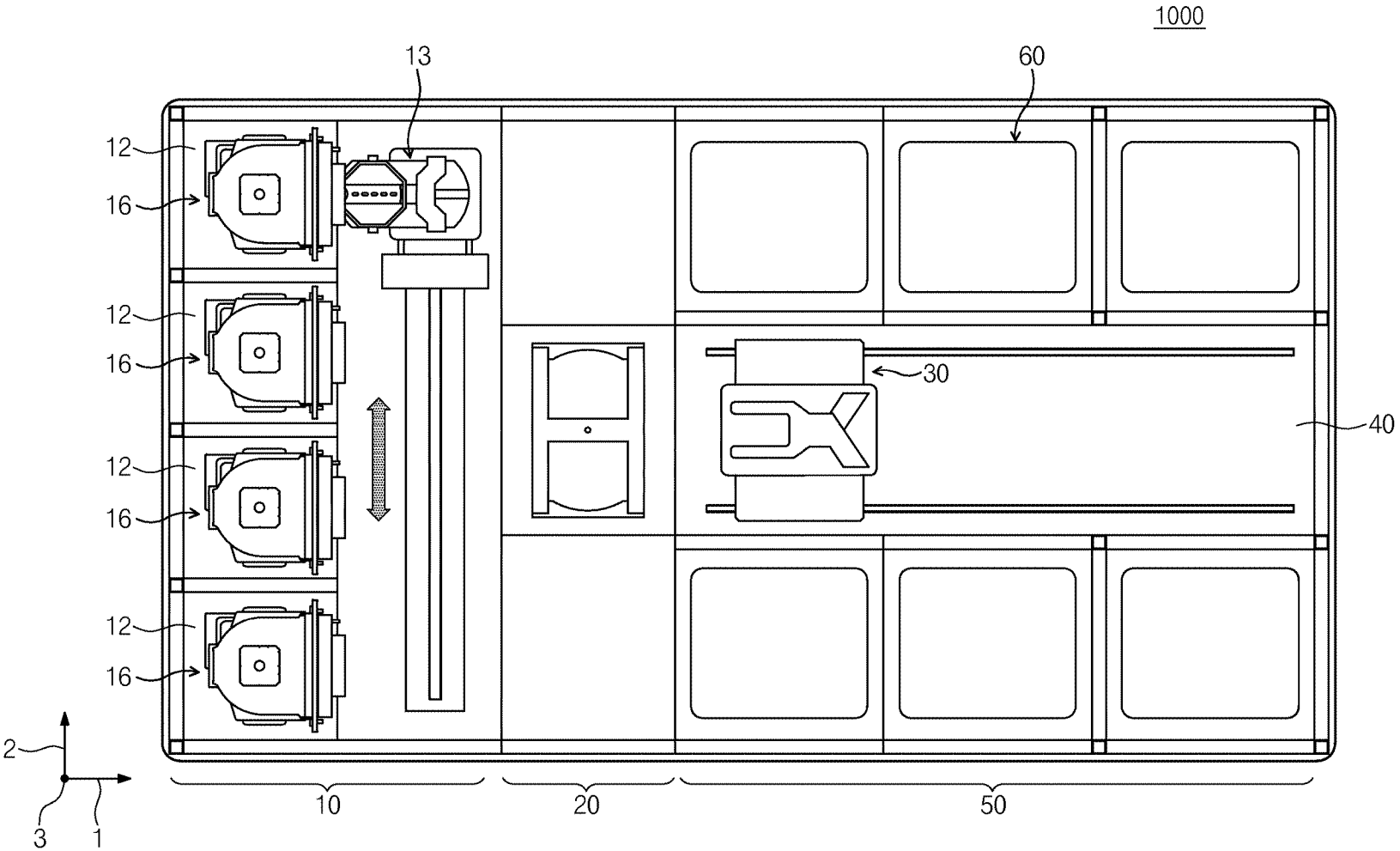
FIG. 1 is a schematic plan view illustrating substrate-treating equipment according to example embodiments of the inventive concepts.

The inventive concepts will now be described more fully hereinafter with reference to the accompanying drawings, in which exemplary embodiments of the inventive concepts are shown. The advantages and features of the inventive concepts and methods of achieving them will be apparent from the following exemplary embodiments that will be described in more detail with reference to the accompanying drawings. It should be noted, however, that the inventive concepts are not limited to the following exemplary embodiments, and may be implemented in various forms. Accordingly, the exemplary embodiments are provided only to disclose the inventive concepts and let those skilled in the art know the category of the inventive concepts. In the drawings, embodiments of the inventive concepts are not limited to the specific examples provided herein and are exaggerated for clarity.

The terminology used herein is for the purpose of describing particular embodiments only and is not intended to limit the invention. As used herein, the singular terms "a," "an" and "the" are intended to include the plural forms as well, unless the context clearly indicates otherwise. As used herein, the term "and/or" includes any and all combinations of one or more of the associated listed items. It will be understood that when an element is referred to as being "connected" or "coupled" to another element, it may be directly connected or coupled to the other element or intervening elements may be present.

Similarly, it will be understood that when an element such as a layer, region or substrate is referred to as being "on" another element, it can be directly on the other element or intervening elements may be present. In contrast, the term "directly" means that there are no intervening elements. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Additionally, the embodiment in the detailed description will be described with sectional views as ideal exemplary views of the inventive concepts. Accordingly, shapes of the exemplary views may be modified according to manufacturing techniques and/or allowable errors. Therefore, the embodiments of the inventive concepts are not limited to the specific shape illustrated in the exemplary views, but may include other shapes that may be created according to manufacturing processes. Areas exemplified in the drawings have general properties, and are used to illustrate specific shapes of elements. Thus, this should not be construed as limited to the scope of the inventive concepts.

It will be also understood that although the terms first, second, third etc. may be used herein to describe various elements, these elements should not be limited by these terms. These terms are only used to distinguish one element from another element. Thus, a first element in some embodiments could be termed a second element in other embodiments without departing from the teachings of the present invention. Exemplary embodiments of aspects of the present inventive concepts explained and illustrated herein include their complementary counterparts. The same reference numerals or the same reference designators denote the same elements throughout the specification.

Moreover, exemplary embodiments are described herein with reference to cross-sectional illustrations and/or plane illustrations that are idealized exemplary illustrations. Accordingly, variations from the shapes of the illustrations as a result, for example, of manufacturing techniques and/or tolerances, are to be expected. Thus, exemplary embodiments should not be construed as limited to the shapes of regions illustrated herein but are to include deviations in shapes that result, for example, from manufacturing. For example, an etching region illustrated as a rectangle will, typically, have rounded or curved features. Thus, the regions illustrated in the figures are schematic in nature and their shapes are not intended to illustrate the actual shape of a region of a device and are not intended to limit the scope of example embodiments.

In the following embodiments of the inventive concepts, a semiconductor substrate will be described as an example of a substrate treated by a substrate treating apparatus 60. However, the inventive concepts are not limited thereto. In other embodiments, the substrate treating apparatus 60 may be applied to various kinds of substrates such as a substrate for a liquid crystal display device, a substrate for a plasma display device, a substrate for a field emission display device, a substrate for an optical disk, a substrate for a magnetic disk, a substrate for an optical magnetic disk, a substrate for a photo-mask, a ceramic substrate, and a substrate for a solar cell.

In the following embodiments of the inventive concepts, an apparatus for cleaning a substrate using various treatment fluids will be described as an example. The various treatment fluids may include high-temperature sulfuric acid, alkaline chemical solution, acid chemical solution, rinse solution, and drying gas. However, the inventive concepts are not limited thereto. Embodiments of the inventive concepts may be applied to various kinds of apparatuses performing a process with rotating a substrate, e.g., an apparatus for performing an etching process.

FIG. 1 is a schematic plan view illustrating substrate-treating equipment according to example embodiments of the inventive concepts.

Referring to FIG. 1, substrate-treating equipment 1000 according to the inventive concepts may include an index module 10, a buffer module 20, and a treating module 50.

The index module 10, the buffer module 20, and the treating module 50 may be sequentially arranged in a line. Hereinafter, a direction in which the load port 120, the transfer frame 140, and the process treating module 200 are arranged may be defined as a first direction 1, a direction perpendicular to the first direction 1 when viewed from a plan view may be defined as a second direction 2, and a direction perpendicular to a plane defined by the first and second directions 1 and 2 may be defined as a third direction 3.

The index module 10 may include a load port 12 and an index robot 13.

The load port 12 may be disposed at the front of the index module 10 in the first direction 1. The load port 12 may be provided in plurality. The plurality of load ports 12 may be arranged along the second direction 2. In an embodiment, four load ports 12 may be provided. The number of the load ports 12 may increase or decrease according to process efficiency and a footprint condition of the process treating module 20. A carrier 16 receiving a substrate W treated or to be treated in a process may be put safely on each of the load ports 12. In an embodiment, the carrier 16 may be a front opening unified pod (FOUP). A plurality of slots (not shown) for receiving the substrates W may be formed in the carrier 16 in such a way that the substrates W received in the slots are disposed horizontally to the ground.

The index robot 13 may be installed between the load port 12 and the buffer module 20. The index robot 13 may transfer a substrate W into the carrier 16 and/or may transfer a substrate W waiting in the carrier 16 into the buffer module 20.

A substrate W treated by the process may temporarily stay in the buffer module 20 before transferred by the index robot 13, and/or a substrate W to be treated by the process may temporarily stay in the buffer module 20 before transferred by a main transfer robot 30.

A substrate W to be transferred into the carrier 16 may wait in an upper layer of the buffer module 20, and a substrate W transferred from the carrier 16 into the buffer module 20 may be located in a lower layer of the buffer module 20.

The treating module 50 may include the main transfer robot 30, a movement path 40, and an apparatus 60 for treating a substrate (hereinafter, referred to as 'a substrate treating apparatus 60'). The substrate treating apparatus 60 may be provided in plurality in the treating module 50.

The main transfer robot 30 may be installed in the movement path 40. The main transfer robot 30 may transfer a substrate W between each of the substrate treating apparatuses 60 and the buffer module 20. The main transfer robot 30 may transfer the substrate W waiting in the buffer module 20 into each of the substrate treating apparatuses 60. The main transfer robot 30 may transfer a substrate W treated in each of the substrate treating apparatus into the buffer module 20.

The movement path 40 may extend along the first direction 1 in the treating module 50. The main transfer robot 30 may move along the movement path 40. The substrate treating apparatuses 60 at both sides of the movement path 40 may face each other and may be arranged along the first direction 1. The main transfer robot 30 may move in the movement path 40 along the first direction 1. A transfer rail may be installed in the main transfer robot 30, and thus, the main transfer robot 30 may be vertically moveable to correspond to the substrate treating apparatuses of lower and upper layers and the lower and upper layers of the buffer module 20.

The substrate treating apparatuses 60 may be disposed at both sides of the movement path 40. The substrate-treating equipment 1000 may include a plurality of the substrate treating apparatuses 60 constituting the lower and upper layers. The number of process chambers 60 may increase or decrease according to process efficiency and a footprint condition of the substrate-treating equipment 1000. Each of the substrate treating apparatuses 60 may include an independent chamber.

Figure 2:
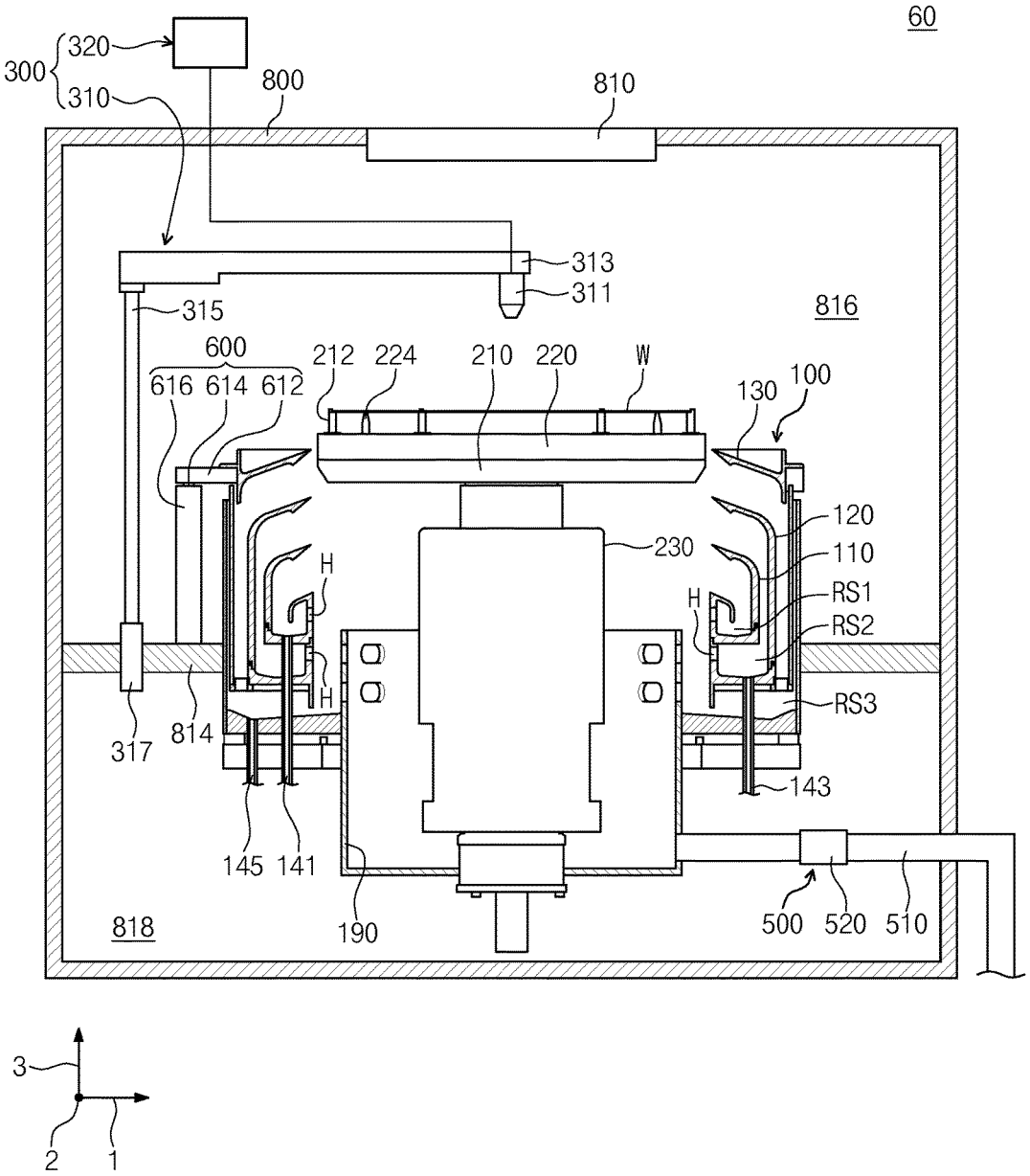
FIG. 2 is a cross-sectional view illustrating a substrate treating apparatus of FIG. 1.
Figure 3:
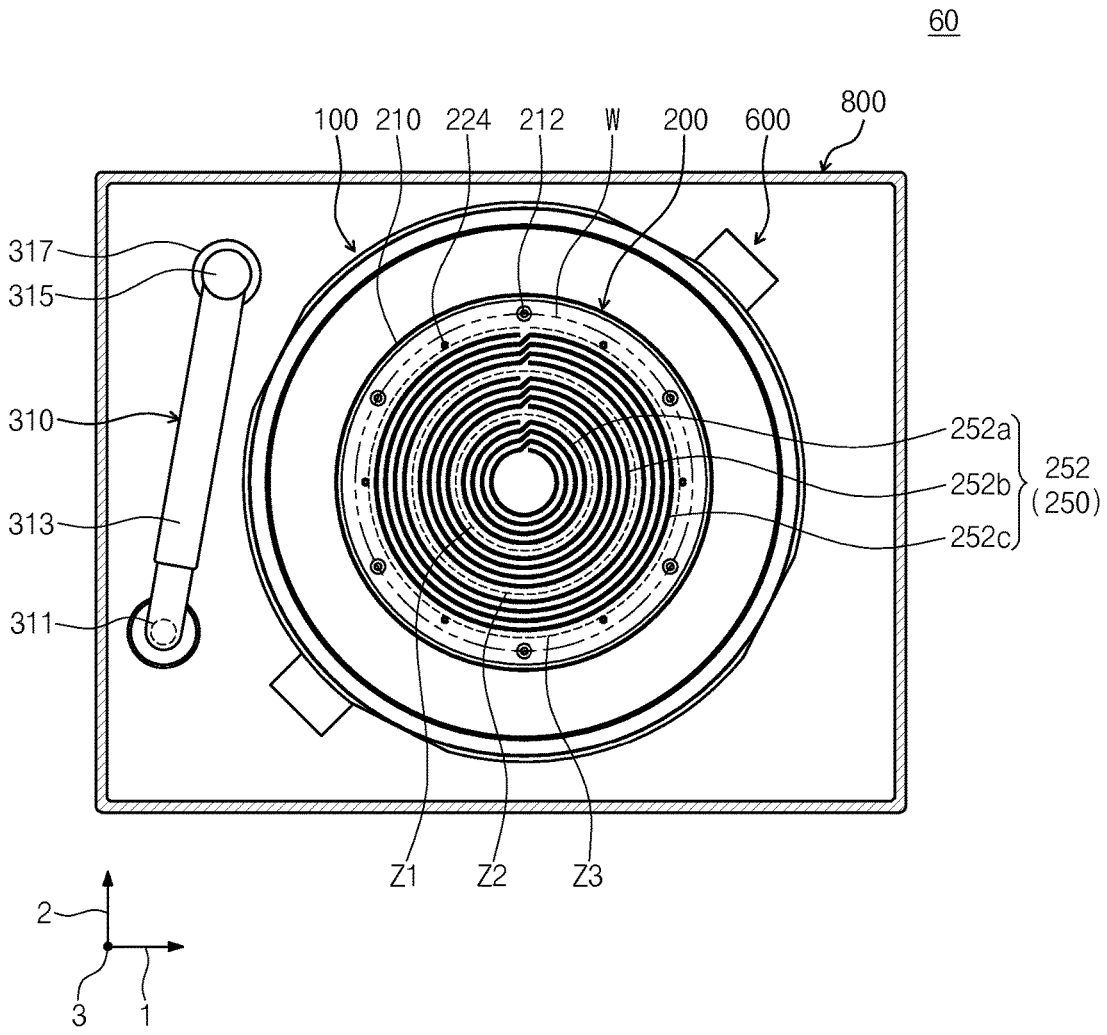
FIG. 3 is a plan view illustrating the substrate treating apparatus of FIG. 1.

FIG. 2 is a cross-sectional view illustrating a substrate treating apparatus of FIG. 1. FIG. 3 is a plan view illustrating the substrate treating apparatus of FIG. 1. Referring to FIGS. 2 and 3, the substrate treating apparatus 60 may include a chamber 800, a treatment container 100, a support unit 200, a chemical solution supply member 300, a process exhaust unit 500, an elevating unit 600, and a heating unit 250.

The chamber 800 may include an inner space that is sealed. A fan filter unit 810 may be installed in an upper portion of the chamber 800. The fan filter unit 810 may generate a descending air current in the chamber 800.

The fan filter unit 810 may include a filter and an air supply fan. The filter and the air supply fan may be modularized into one unit. The fan filter unit 810 may filter external air to supply the filtered air into the chamber 800. The external air may penetrate the fan filter unit 810 so as to be supplied into the chamber 800, so the descending air current may be generated using the external air in the chamber 800.

The chamber 800 may be divided into a process region 816 and a maintenance region 818 by a horizontal partition 814. Even though a portion of the maintenance region 818 is shown in FIG. 2, the maintenance region 818 may receive collecting lines 141, 143 and 145 connected to the treatment container 100, an exhaust line 510, a driving part of the elevating unit 600, a driving part connected to a chemical solution nozzle member 310, and a supply line. The maintenance region 818 may be isolated from the process region 816 in which the substrate W is treated.

The treatment container 100 may have a cylindrical shape having an opened top end. The treatment container 100 may provide a treatment space in which the substrate W is treated. The opened top end of the treatment container 100 may be provided as a path through which the substrate W is carried into and/or carried from the treatment container 100. The support unit 200 may be located in the treatment space. The support unit 200 may heat and rotate the substrate W during the process while supporting the substrate W.

An exhaust duct 190 may be connected to a bottom end portion of a lower space of the treatment container 100 to forcibly deflate the treatment container 100. First, second, and third collecting vessels 110, 120, and 130 having ring shapes may be vertically stacked in the treatment container 100 to receive and absorb a chemical solution and a gas scattered from the rotated substrate W.

The first, second, and third collecting vessels 110, 120, and 130 having the ring shapes may have exhaust openings H connected to one common ring-shaped space.

In more detail, each of the first, second, and third collecting vessels 110, 120, and 130 may have a bottom surface having a ring shape, and a sidewall extending from the bottom surface and having a cylindrical shape. The second collecting vessel 120 may surround the first collecting vessel 110 and may be spaced apart from the first collecting vessel 110. The third collecting vessel 130 may surround the second collecting vessel 110 and may be spaced apart from the second collecting vessel 120.

The first, second, and third collecting vessels 110, 120, and 130 may include first, second, and third collecting spaces RS1, RS2, and RS3 in which a treatment solution and fumes scattered from the substrate W. The first collecting space RS1 may be provided in the first collecting vessel 110. The second collecting space RS2 may be provided in a space between the first and second collecting vessels 110 and 120. The third collecting space RS3 may be provided in a space between the second and third collecting vessels 120 and 130.

A central portion of a top surface of each of the first, second, and third collecting vessels 110, 120, and 130 may be opened. The top surface of each of the first, second, and third collecting vessels 110, 120, and 130 may have a surface inclined gradually upward from a top end of the sidewall of each of the first, second, and third collecting vessels 110, 120, and 130 to the opened region of the top surface. Thus, the treatment solutions scattered from the substrate W may flow into the collecting spaces RS1, RS2, and RS3 along the top surfaces of the first, second, and third collecting vessels 110, 120, and 130.

A first treatment solution provided in the first collecting space RS1 may be exhausted to the outside through a first collecting line 141. A second treatment solution provided in the second collecting space RS2 may be exhausted to the outside through a second collecting line 143. A third treatment solution provided in the third collecting space RS3 may be exhausted to the outside through a third collecting line 145.

The process exhaust unit 500 may be used for exhaust of the inside of the treatment container 100. In an embodiment, the process exhaust unit 500 may provide exhaust pressure to one collecting vessel, collecting the treatment solution, of the first, second, and third collecting vessels 110, 120, and 130. The process exhaust unit 500 may include the exhaust line 510 and a damper 520. The exhaust line 510 may be connected to the exhaust duct 190. The exhaust line 510 may receive the exhaust pressure from an exhaust pump (not shown) and may be connected to a main exhaust line disposed in a bottom space of a semiconductor product line.

The treatment container 100 may be coupled to the elevating unit 600 used for changing a vertical position of the treatment container 100. The elevating unit 600 may linearly move the treatment container 100 in up and down directions. Since the treatment container 100 vertically moves, a relative height of the treatment container 100 with respect to the support unit 200 may be changed.

The elevating unit 600 may include a bracket 612, a movement shaft 614, and an actuator 616. The bracket 612 may be installed on an outer wall of the treatment container 100. The movement shaft 614 movable in the up and down directions by the actuator 616 may be coupled to the bracket 612. The treatment container 100 may descend when the substrate W is loaded on a chuck stage 210 or is unloaded from the chuck stage 210, and thus, the chuck stage 210 may protrude from a top end of the treatment container 100. The vertical position of the treatment container 100 may be adjusted according to a kind of the treatment solution supplied onto the substrate W during the process in such a way that the treatment solution flows into a predetermined one of the collecting vessels 110, 120, and 130. At this time, a relative vertical position between the treatment container 100 and the substrate W may be changed. Thus, kinds of the treatment solutions and contamination gases respectively collected through the collecting spaces RS1, RS2, and RS3 may be different from each other.

In some embodiments, the substrate treating apparatus 60 may vertically move the treatment container 100 to change the relative vertical positions between the treatment container 100 and the support unit 200. However, the inventive concepts are not limited thereto. In other embodiments, the substrate treating apparatus 60 may vertically move the support unit 200 to change the relative vertical positions between the treatment container 100 and the support unit 200.

The chemical solution supply member 300 may discharge a high-temperature chemical to etch a surface of the substrate W. For example, the chemical may include sulfuric acid, phosphoric acid, or a mixture solution of sulfuric acid and phosphoric acid.

The chemical solution supply member 300 may include a chemical solution nozzle member 310 and a supply part 320.

The chemical solution nozzle member 310 may include a nozzle 311, a nozzle arm 313, a support rod 315, and a nozzle actuator 317. The nozzle 311 may receive the chemical (e.g., phosphoric acid) from the supply part 320. The nozzle 311 may discharge the phosphoric acid to the surface of the substrate W. The nozzle arm 313 may extend in one direction. The nozzle 311 may be installed on a front end of the nozzle arm 313. The nozzle arm 313 may support the nozzle 311. The support rod 315 may be installed on a rear end of the nozzle arm 313. The support rod 315 may be disposed under the nozzle arm 313. The support rod 315 may be perpendicular to the nozzle arm 313. The nozzle actuator 317 may be connected to a bottom end of the support rod 315. The nozzle actuator 317 may rotate the support rod 315 on a length-directional axis of the support rod 315. The nozzle arm 313 and the nozzle 311 may swing on the support rod 315 by the rotation of the support rod 315. The nozzle 311 may be swung between the outside and the inside of the treatment container 100. The nozzle 311 may discharge the phosphoric acid while swing in a section between a central region and an edge region of the substrate W.

Even though not shown in the drawings, the substrate treating apparatus 60 may further include additional supply members supplying various treatment fluids to the substrate W.

The support unit 200 may be installed within the treatment container 100. The support unit 200 may include the chuck stage 210, a quartz window 220, and a rotation part 230.

The chuck stage 210 may have a circular top surface. The chuck stage 210 may be coupled to the rotation part 230 so as to be rotatable. The chuck stage 210 may include chucking pins 212 and support pins 224.

The chucking pins 212 may be installed on an edge of the chuck stage 210. The chucking pins 212 may penetrate the quartz window 220 to protrude upward from the quartz window 220. The chucking pins 212 may align the substrate W such that the substrate W supported by the support pins 224 is disposed at a desired position. In addition, the chucking pins 212 may be in contact with a sidewall of the substrate W during the process to prevent the substrate from deviating from the desired position. The support pins 224 may support the substrate W.

The quartz window 220 may be disposed between the heating unit 250 and the substrate W. The quartz window 220 may protect a heater 252 of the heating unit 250. The quartz window 220 may be formed of a transparent material. The quartz window 220 may be rotated along with the chuck stage 210. The support pins 224 may penetrate the quartz window 220. The support pins 224 may be arranged at equal intervals on an edge of a top surface of the quartz window 220. The support pins 224 may protrude upward from the quartz window 220. The support pins 224 may support a bottom surface of the substrate W such that the substrate W is spaced apart from the quartz window 220 in an up direction.

The rotation part 230 may have a hollow shape and may be coupled to the chuck stage 210 to rotate the chuck stage 210.

Figure 4:
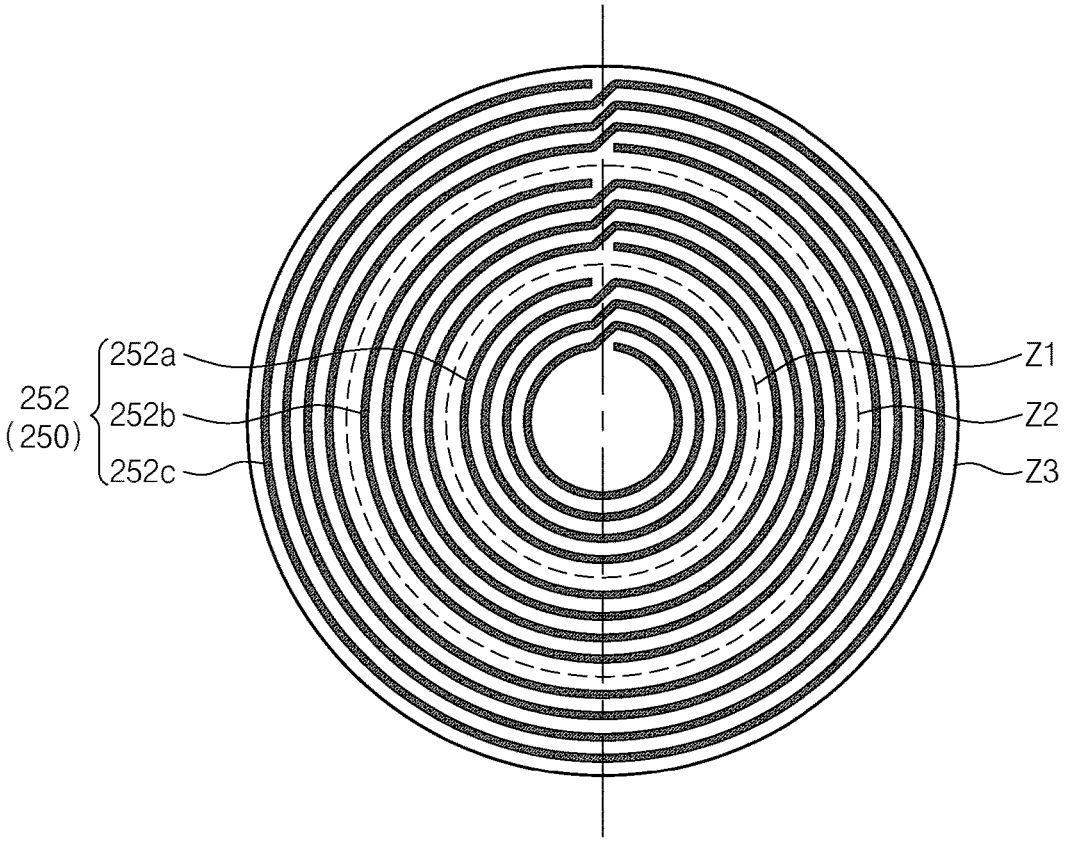
FIG. 4 is a view illustrating a heating unit of FIG. 3.
Figure 5:
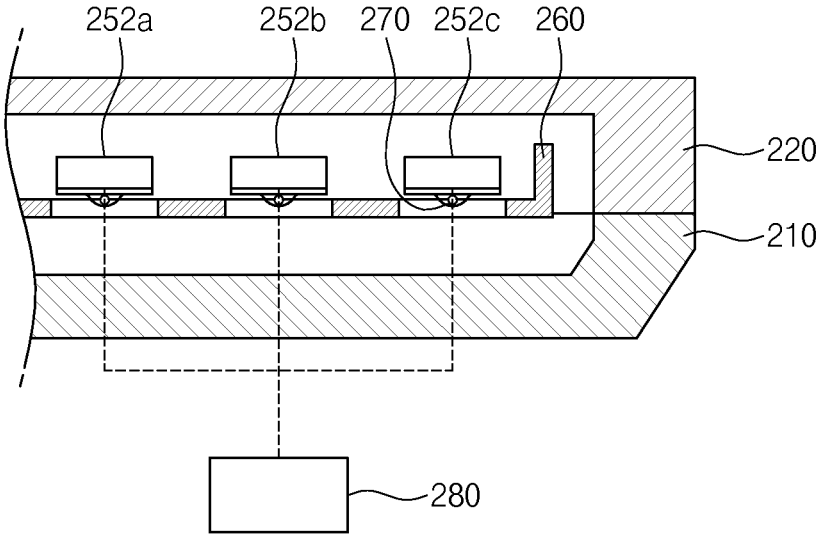
FIG. 5 is a cross-sectional view illustrating a support unit of FIG. 4.

FIG. 4 is a view illustrating the heating unit 250 of FIG. 3. FIG. 5 is a cross-sectional view illustrating the support unit 200 of FIG. 4. The heating unit 250 may be provided on the support unit 200. For example, the heating unit 250 may be provided in the inside of the support unit 200, as illustrated in FIG. 5. The heating unit 250 may include the heater 252, a reflection plate 260, a temperature-sensor assembly 270, and a controller 280.

The heater 252 may be provided on the chuck stage 210. The heater 252 may be provided in plurality. The plurality of heaters 252*a*, 252*b*, and 252*c* may be installed to correspond to a plurality of zones of the support unit 200, respectively. The plurality of zones may include a central zone and an edge zone. The central zone having a circular shape may be concentric with the support unit 200. The edge zone may have a ring shape that is concentric with the central zone. Hereinafter, the heating unit 250 having the heaters corresponding to one central zone and two edge zones will be described as an example. The heating unit 250 may heat the substrate W to a temperature of 150 degrees Celsius to 250 degrees Celsius. However, the inventive concepts are not limited thereto. Alternatively, the number of the zones and the number of the heaters may be variously modified.

Referring to FIG. 4, the support unit 200 may have a first zone Z1, a second zone Z2, and a third zone Z3. A first heater 252*a*, a second heater 252*b*, and a third heater 252*c* may be installed in the first zone Z1, the second zone Z2, and the third zone Z3, respectively. The first heater 252*a* may heat the first zone Z1, the second heater 252*b* may heat the second zone Z2, and the third heater 252*c* may heat the third zone Z3. At this time, the first heater 252*a*, the second heater 252*b*, and the third heater 252*c* may be operated independently of each other. Each of the first, second, and third heaters 252*a*, 252*b*, and 252*c* may include a lamp. For example, each of first heater 252*a*, a second heater 252*b*, and a third heater 252*c* may include a plurality of infrared ray (IR) lamps. In the embodiments of the inventive concepts, three IR lamps are illustrated in FIG. 4. However, the inventive concepts are not limited thereto. The number of the IR lamps may increase or decrease depending on a desired temperature or controlled degree. Since the heating unit 250 may individually control temperatures of the zones of the support unit 200, the temperature may be monotonously and uniformly controlled according to a radius of the substrate W during the process. At this time, the first, second, and third heaters 252*a*, 252*b*, and 252*c* may be arranged at the equal distances. For example, the first, second, and third heaters 252*a*, 252*b*, and 252*c* may have ring shapes that are concentric with each other.

The reflection plate 260 may be provided between the heater 252 and the chuck stage 210. Heats generated from the heaters 252*a*, 252*b*, and 252*c* may be transmitted upward by the reflection plate 260. The reflection plate 260 may be supported by a nozzle body that penetrates a central space of the rotation part 230 so as to be installed. The reflection plate 260 may include a bottom portion and a wall portion extending upward from an edge of the bottom portion. The reflection plate 260 may include a support end portion that is supported on the rotation part 230 through a bearing. The reflection plate 260 may be fixed, so it may not be rotated along with chuck stage 210.

Even though not shown in the drawings, cooling fins may be installed on the reflection plate 260 to radiate heat of the reflection plate 260. A cooling gas may flow on a bottom surface of the reflection plate 260 to inhibit heat generation of the reflection plate 260.

The temperature-sensor assembly 270 may individually control the temperature of each of the heaters 252*a*, 252*b*, and 252*c*. The temperature-sensor assembly 270 may be installed on the reflection plate 260. For example, the temperature-sensor assemblies 270 may be installed in a line on the reflection plate 260 to measure the temperatures of the heaters 252*a*, 252*b*, and 252*c*, respectively.

The controller 280 may control the heating unit 250. The controller 280 may control the plurality of heaters 252*a*, 252*b*, and 252*c* independently of each other. The controller 280 may control the heaters 252*a*, 252*b*, and 252*c* by a first mode and a second mode. The first mode may correspond to a mode in which the controller 280 controls the heaters 252*a*, 252*b*, and 252*c* until the temperatures of the zones Z1, Z2, and Z3 reach a target temperature. The second mode may correspond to a mode in which the controller 280 controls the heaters 252*a*, 252*b*, and 252*c* after the temperatures of the zones Z1, Z2, and Z3 reach the target temperature. In the first mode, the controller 280 may control the plurality of heaters 252*a*, 252*b*, and 252*c* together. The controller 280 may provide the plurality of heaters 252*a*, 252*b*, and 252*c* with powers different from each other. For example, the power provided to the central zone may be greater than the power provided to the edge zone. In more detail, in the first mode, a power P1 provided to the first heater 252*a* may be greater than a power P2 provided to the second heater 252*b*, and the power P2 may be greater than a power P3 provided to the third heater 252*c*. Thereafter, in the second mode, the controller 280 may control the plurality of heaters 252*a*, 252*b*, and 252*c* independently of each other. For example, the controller 280 may control each of the heaters 252*a*, 252*b*, and 252*c* by a proportional integral derivative (PID) control method.

Figure 6:
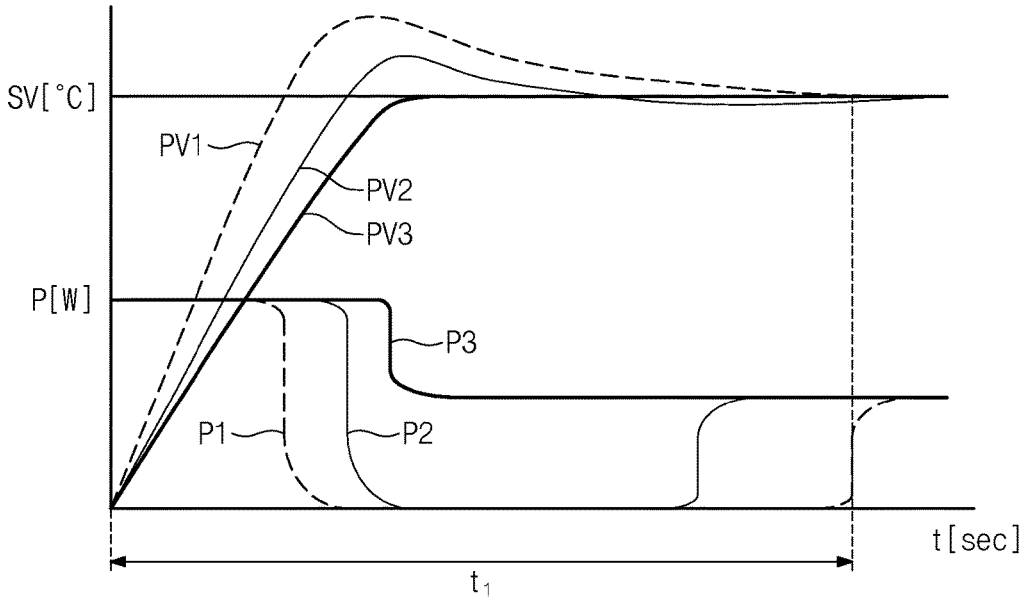
FIG. 6 is a graph illustrating a process of controlling the heating unit of FIG. 4 according to a conventional substrate treating method.
Figure 7:
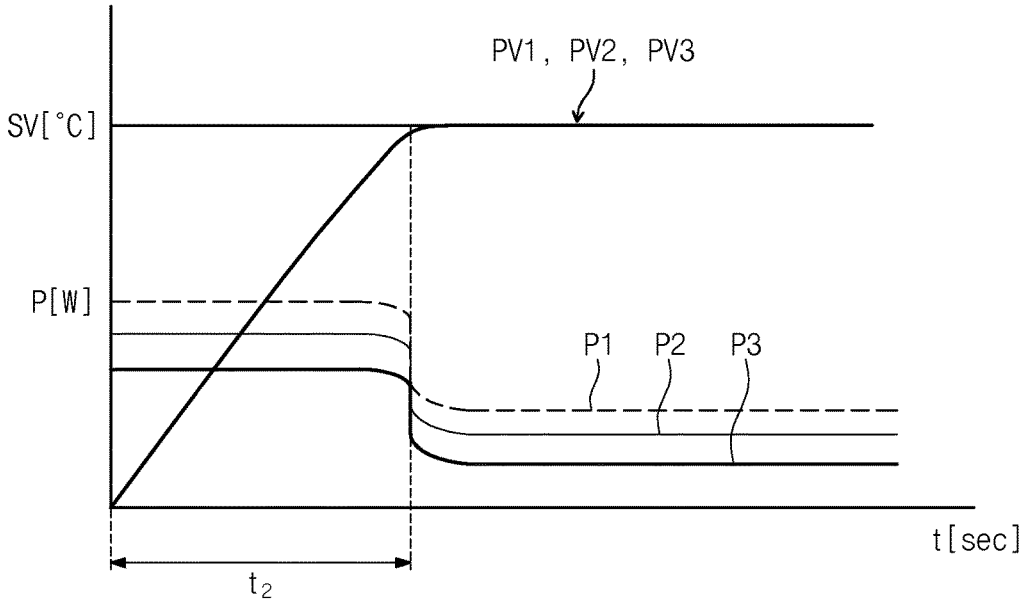
FIG. 7 is a graph illustrating a process of controlling the heating unit of FIG. 4 according to example embodiments of the inventive concepts.
Figure 8:
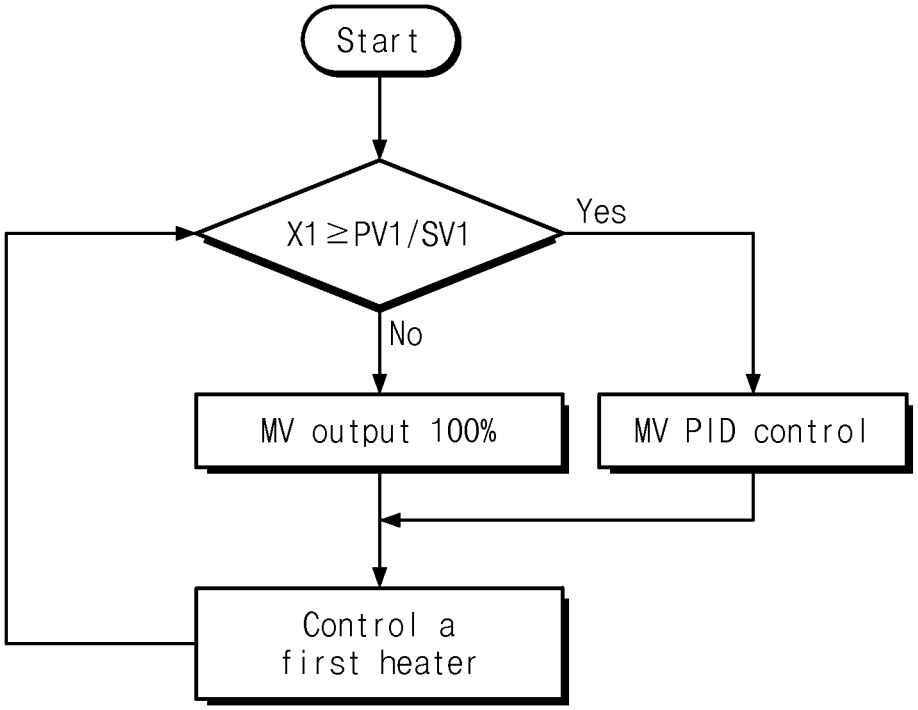
FIG. 8 is a flow chart illustrating a process of controlling a first heater by a controller.
Figure 9:
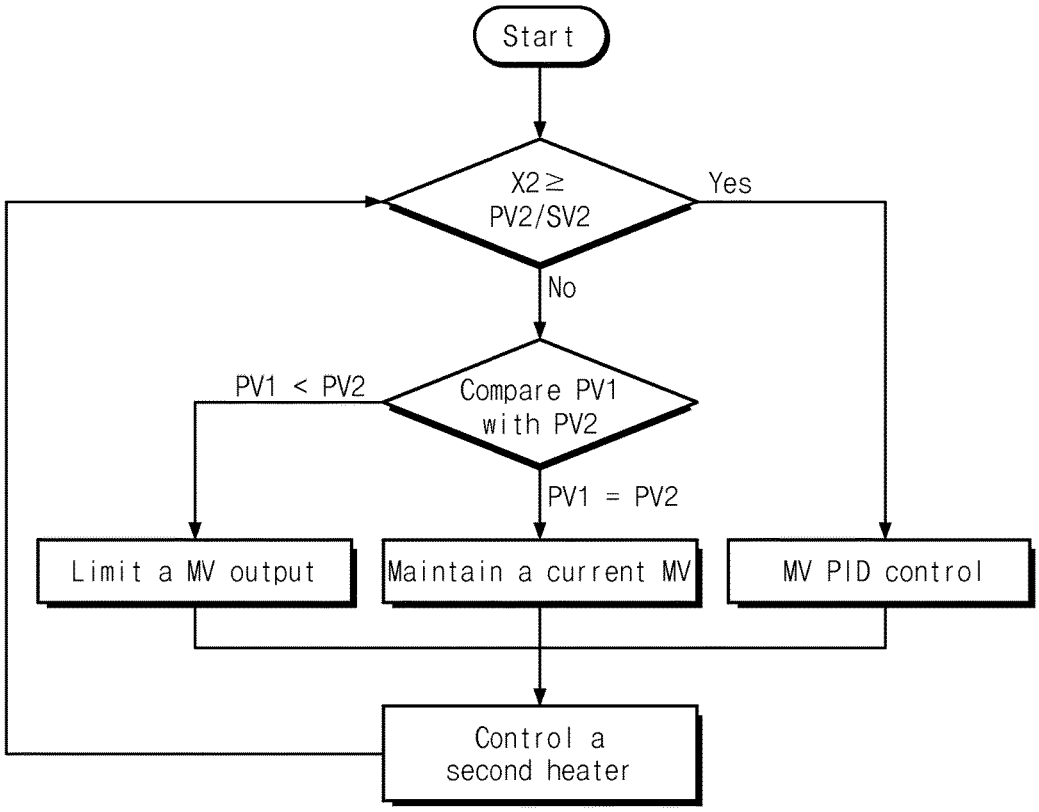
FIG. 9 is a flow chart illustrating a process of controlling a second heater by the controller.
Figure 10:
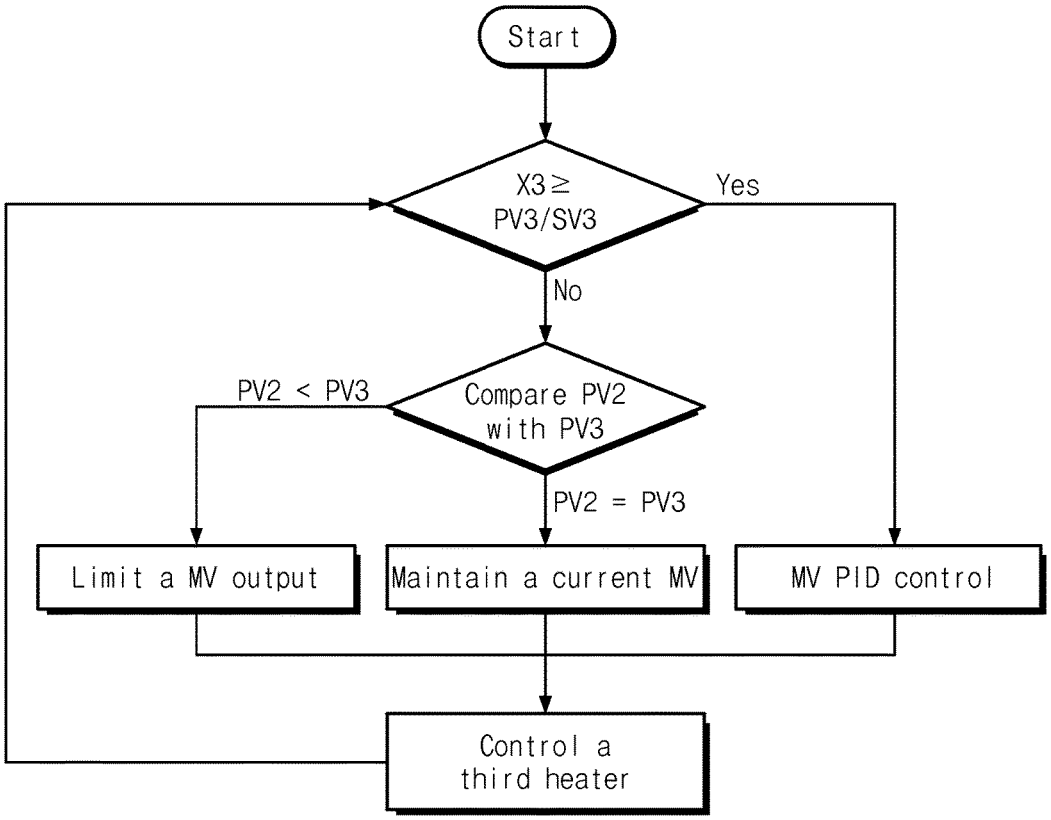
FIG. 10 is a flow chart illustrating a process of controlling a third heater by the controller.

FIG. 6 is a graph illustrating a process of controlling the heating unit of FIG. 4 according to a conventional substrate treating method. FIG. 7 is a graph illustrating a process of controlling the heating unit of FIG. 4 according to example embodiments of the inventive concepts. FIG. 8 is a flow chart illustrating a process of controlling the first heater 252*a* by the controller 280. FIG. 9 is a flow chart illustrating a process of controlling the second heater 252*b* by the controller 280. FIG. 10 is a flow chart illustrating a process of controlling the third heater 252*c* by the controller 280. Hereinafter, a process of controlling a temperature by the controller 280 will be described with reference to FIGS. 7 to 10.

If the heating unit 250 of FIG. 4 is operated by a conventional method, the plurality of heaters 252*a*, 252*b*, and 252*c* may be supplied with the same power P in order to reach the same target temperature SV. However, in this case, heat-transmission rates per unit area of the heaters 252*a*, 252*b*, and 252*c* may be different from each other, and thus, temperature-rising rates of the heaters 252*a*, 252*b*, and 252*c* may be different from each other. In addition, since the plurality of heaters 252*a*, 252*b*, and 252*c* are controlled, a coupling effect may occur between the heaters 252*a*, 252*b*, and 252*c*. Thus, sensing values PV1, PV2, PV3 of the temperature sensor assemblies 270 may be different from each other by interference influencing an entire portion of the substrate. For example, as illustrated in FIG. 6, even though the first zone Z1 reaches the target temperature SV to control the supply power of the first heater 252*a*, the second zone Z2 and the third zone Z3 may be heated in order to reach the target temperature SV. Thus, the first zone Z1 may be affected by the second zone Z2 surrounding the first zone Z1. In other words, the temperature of the first zone Z1 may exceed the target temperature SV by occurrence of a hunting phenomenon. In addition, even though the second zone Z2 reaches the target temperature SV to control the supply power of the second heater 252*b*, the third zone Z3 may be heated in order to reach the target temperature SV. Thus, the second zone Z2 may be affected by the third zone Z3 surrounding the second zone Z2. In other words, the temperature of the second zone Z2 may exceed the target temperature SV by occurrence of a hunting phenomenon. As a result, a time $t_1$ for stabilizing the temperature of the substrate may increase, and the hunting phenomenon may occur.

However, in the method for treating a substrate according to example embodiments of the inventive concepts, the powers P1, P2, and P3 of the first, second, and third heaters 252*a*, 252*b*, and 252*c* are different from each other in the first mode, as illustrated in FIG. 7. For example, the power P1 of the first heater 252*a* may be greater than the power P2 of the second heater 252*b*, and the power P2 of the second heater 252*b* may be greater than the power P3 of the third heater 252*c*. In some embodiments, the power applied to the heater having the lowermost temperature-rising rate may be normally set, and the powers applied to the other heaters may be set to limit their temperature-rising rates. As a result, it is possible to prevent the hunting phenomenon from occurring by the interference between the plurality of heaters 252*a*, 252*b*, and 252*c*. In addition, the time $t_2$ for stabilizing the temperature of the substrate may be reduced.

The controller 280 may compare a previously set manual value (MV) output with a parameter (X=PV/SV) measured in real time from the heating unit 250, thereby selecting one of the first mode and the second mode. In the first mode, the controller 280 may compare previous data error values between the heaters 252*a*, 252*b*, and 252*c* with each other to determine an output value. For example, the controller 280 may analyze the previous data by a feed forward method. Thereafter, in the second mode after reaching the target temperatures SV1, SV2, SV3, the controller 280 may change the feed forward method into the PID control method of each of the heaters 252*a*, 252*b*, and 252*c*. In addition, the controller 280 may compare an output of the second heater 252*b* with an output of the first heater 252*a* to control the second heater 252*b* in such a way that the first zone Z1 is not affected by the second zone Z2. Furthermore, the controller 280 may compare an output of the third heater 252*c* with the output of the second heater 252*b* to control the third heater 252*c* in such a way that the second zone Z2 is not affected by the third zone Z3.

In the above mentioned embodiment of the inventive concepts, three heating zones are described as an example. Alternatively, the number of the heating zones may be variously modified. In addition, the heater including the ring-shaped lamp is described as an example in the above mentioned embodiment. Alternatively, the shape of the heater may be variously modified, and the heater may be realized as another heating unit, not the lamp. Furthermore, the etching process is described as an example in the aforementioned embodiment. However, the inventive concepts are not limited thereto. The apparatus according to the inventive concepts may be applied to other various processes using the heating unit.

According to example embodiments of the inventive concepts, cleaning rates of the zones of the substrate may be substantially uniform in the cleaning process of the substrate.

According to example embodiments of the inventive concepts, the temperature may be uniformly provided to the entire zone of the substrate during the cleaning process, so the cleaning rates of the zones of the substrate may be substantially uniform.

While the inventive concepts have been described with reference to example embodiments, it will be apparent to those skilled in the art that various changes and modifications may be made without departing from the spirits and scopes of the inventive concepts. Therefore, it should be understood that the above embodiments are not limiting, but illustrative. Thus, the scopes of the inventive concepts are to be determined by the broadest permissible interpretation of the following claims and their equivalents, and shall not be restricted or limited by the foregoing description.

What is claimed is:

1. A method for treating a substrate, the method comprising:

uniformly heating the substrate supported by a support unit by means of a plurality of heaters respectively installed in a plurality of zones of the support unit, the uniformly heating including, heating the plurality of heaters in a first mode until the plurality of zones reach a target temperature, the first mode being a mode in which the plurality of heaters are provided with powers different from each other, and heating the plurality of heaters in a second mode different from the first mode after the plurality of zones reach the target temperature, wherein the plurality of heaters includes a first heater having a lowermost temperature-rising rate and the other heaters, and the heating the plurality of heaters to be in the first mode including (1) setting a first power to be provided to the first heater and (2) setting second powers applied to the other heaters to limit temperature-rising rates thereof, the heating the plurality of heaters in the first mode includes heating the plurality of heaters using a feed forward method, and the heating the plurality of heaters in the second mode includes heating the plurality of heaters using a proportional integral derivative (PID) controller.

2. The method of claim 1, wherein the plurality of zones comprise a central zone having a circular shape concentric with the support unit, and an edge zone having a ring shape concentric with the central zone.

3. The method of claim 2, wherein the plurality of heaters include a plurality of lamps, respectively, and distances between the lamps disposed in the plurality of zones are substantially equal.

4. The method of claim 3, wherein the lamps have ring shapes concentric with the support unit.

5. The method of claim 4, wherein the lamps included in the plurality of heaters are provided with the first power and each of the second powers that are different from each other in the first mode.

6. The method of claim 5, wherein the first power is provided to a first lamp of the lamps disposed in the central zone, one of the second powers is provided to a second lamp of the lamps disposed in the edge zone, and the first power is greater than the one of the second powers.

* * * * *